US008925225B2

(12) United States Patent
Fiore

(10) Patent No.: US 8,925,225 B2
(45) Date of Patent: Jan. 6, 2015

(54) MAILBOX PROTECTOR

(71) Applicant: Judith Fiore, Richfield, OH (US)

(72) Inventor: Judith Fiore, Richfield, OH (US)

( * ) Notice: Subject to any disclaimer, the term of this patent is extended or adjusted under 35 U.S.C. 154(b) by 0 days.

(21) Appl. No.: 13/794,076

(22) Filed: Mar. 11, 2013

(65) Prior Publication Data

US 2013/0232834 A1 Sep. 12, 2013

Related U.S. Application Data

(60) Provisional application No. 61/609,894, filed on Mar. 12, 2012.

(51) Int. Cl.
*A47G 29/122* (2006.01)

(52) U.S. Cl.
CPC ..... *A47G 29/122* (2013.01); *A47G 29/1216* (2013.01)
USPC ..... 40/606.12; 40/612; 40/606.06; 232/39; 52/293.1

(58) Field of Classification Search
USPC ..... 52/296, 297, 298; 160/352, 351, 135; 40/606.12, 606.06, 606.01
See application file for complete search history.

(56) References Cited

U.S. PATENT DOCUMENTS

| | | | | |
|---|---|---|---|---|
| 3,605,851 | A * | 9/1971 | Miles et al. | 160/135 |
| 4,187,978 | A | 2/1980 | Dowker | |
| 4,491,166 | A * | 1/1985 | Hanna | 160/351 |
| 5,425,501 | A | 6/1995 | Wesorick | |
| 5,460,326 | A | 10/1995 | Albanesius | |
| 5,848,502 | A * | 12/1998 | Schaefer | 52/165 |
| 5,903,992 | A * | 5/1999 | Eisenberg | 40/738 |
| D438,125 | S * | 2/2001 | Kaposi et al. | D10/46.2 |
| 6,543,164 | B1 * | 4/2003 | Sperl et al. | 40/605 |
| 6,807,782 | B2 * | 10/2004 | Forman et al. | 52/293.1 |
| 6,824,113 | B1 * | 11/2004 | Gee et al. | 248/218.4 |
| 6,962,460 | B1 * | 11/2005 | Pratt | 404/6 |
| 7,080,773 | B1 * | 7/2006 | Tepley | 232/17 |
| 7,364,066 | B1 | 4/2008 | Wilson | |
| 7,611,043 | B2 | 11/2009 | Black | |
| 7,611,044 | B1 | 11/2009 | Wilson | |
| 2010/0243977 | A1 | 9/2010 | Middlebrook, Jr. | |

* cited by examiner

*Primary Examiner* — Casandra Davis
(74) *Attorney, Agent, or Firm* — Dominic A. Frisina

(57) ABSTRACT

A mailbox protector may include a deflection surface adapted to deflect impacting snow and debris thrown by a snow plow. A mailbox protector may also include at least one anchor member in a fixed relation to the deflection surface. It may further include a complementary anchor member adapted to engage the at least one anchor member in a mounting relation. Furthermore, the at least one complementary anchor member may be adapted to be fixedly disposed in an arbitrary substrate such as concrete, or soil.

9 Claims, 2 Drawing Sheets

MAILBOX PROTECTOR

I. CROSS REFERENCE TO RELATED APPLICATIONS

This application claims priority to U.S. Provisional Patent Application No. 61/609,894 filed on Mar. 12, 2013, which is incorporated herein by reference in its entirety.

II. BACKGROUND OF THE INVENTION

A. Field of Invention

One or more embodiments may relate to devices and/or methods for protecting roadside mailboxes from impacts.

B. Description of the Related Art

Roadside mailboxes are commonplace in the United States, and protecting such mailboxes from damage has long been a problem. Traditional roadside mailboxes offer no protection at all from snow and/or debris thrown by snow plows, for instance. While certain remedies have been attempted, they typically require one to purchase a specially designed mailbox, or to fortify a traditional mailbox with brick or other improvements which may be costly and otherwise undesirable.

One or more embodiments of the present invention may offer improvements or advantages over the prior art.

III. SUMMARY OF THE INVENTION

Some embodiments of the present invention relate to a mailbox protector, comprising: a deflection surface adapted to deflect impacting snow and debris thrown by a snow plow; at least one anchor member in a fixed relation to the deflection surface; and at least one complementary anchor member adapted to engage the at least one anchor member in a mounting relation, wherein the at least one complementary anchor member is adapted to be fixedly disposed in an arbitrary substrate selected from one or more of concrete, or soil.

According to some embodiments the at least one anchor member defines a fixed post which is in a fixed relation to the deflection surface.

Embodiments may also include a sliding post adapted to be received within an inner diameter of the fixed post in a slideable relation.

Embodiments may also include a means for fixing the position of the sliding post in relation to the fixed post.

According to some embodiments the at least one complementary anchor member comprises a female anchor member adapted to receive the fixed post in a mounted relation.

According to some embodiments the deflection surface comprises one or more of an arcuate major surface, or an angular major surface comprised of two flat sides defining a vertex.

Embodiments may also include a first frame member fixedly disposed at a first edge of the deflection surface and mounted thereto, and a second frame member fixedly disposed at a second edge of the deflection surface and mounted thereto, both the first and second frame members running substantially the entire length of the respective first and second sides of the deflection surface.

According to some embodiments the deflection surface comprises a plurality of panels joined edge to edge.

Embodiments may also include a cap member adapted to fixedly engage an upper edge of the deflection surface.

According to some embodiments a mailbox protector may comprise at least one panel comprising a generally rectangular shape having a first major surface and a second major surface spaced apart from the first major surface in a generally parallel relation and defining a thickness, the major surfaces defining a generally curved shape, and the at least one panel defining an upward edge and a downward edge; and at least one anchor member extending beyond the downward edge of the at least one panel and adapted to engage an arbitrary substrate in a fixed relation.

According to some embodiments the at least one anchor member includes a female component adapted to be embedded in an arbitrary substrate and engage a male component of the anchor member in a fixed relation.

Embodiments may also include a cap member adapted to fixedly engage the upward edge of at least one panel, the cap member comprising a substantially continuous sheet spanning a curved upward edge of the panel.

Embodiments may also include comprising a panel including visual indicia, the panel being disposed on an outward facing major surface.

According to some embodiments the at least one anchor member comprises three evenly spaced anchor members.

Embodiments may also include a plurality of panels wherein the plurality of panels is fixedly engaged edge to edge by their respective upward and/or downward edges.

According to some embodiments the at least one anchor member is length-adjustable.

According to some embodiments a length of the at least one panel is selected from about 1 to 2 feet, 2 to 3 feet, 3 to 4 feet, 4 to 5 feet, 5 to 6 feet, 6 to 7 feet, 7 to 8 feet, 8 to 9 feet, 9 to 10 feet, or any combination thereof.

Some embodiments may relate to a mailbox protector, comprising: a deflection surface adapted to deflect impacting snow and debris thrown by a snow plow, wherein the deflection surface comprises one or more of an arcuate major surface, or an angular major surface comprised of two flat sides defining a vertex, and wherein the deflection surface comprises a plurality of panels each having an upward edge and a downward edge, the plurality of panels being joined upward edge to downward edge; a frame comprising a first frame member fixedly disposed at a first side edge of the deflection surface and mounted thereto, and a second frame member fixedly disposed at a second side edge of the deflection surface and mounted thereto, both the first and second frame members running substantially the entire length of the respective first and second side edges of the deflection surface; at least one anchor member in a fixed relation to the deflection surface, wherein the at least one anchor member comprises a fixed post and a sliding post adapted to be received within an inner diameter of the fixed post in a slideable relation, and the at least one anchor member further comprising a means for fixing the position of the sliding post in relation to the fixed post; at least one complementary anchor member comprising a female anchor member adapted to engage the at least one anchor member in a mounting relation, wherein the at least one complementary anchor member is adapted to be fixedly disposed in an arbitrary substrate selected from one or more of concrete, or soil; and a cap member adapted to fixedly engage an upper edge of the deflection surface.

Embodiments may also include three evenly spaced anchor members.

Embodiments may also include visual indicia disposed on an outward facing major surface of the deflection surface, wherein the visual indicia comprises one or more of an address number, or a surname.

Other benefits and advantages will become apparent to those skilled in the art to which it pertains upon reading and understanding of the following detailed specification.

VI. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

V. DETAILED DESCRIPTION OF THE INVENTION

Embodiments can comprise a device for protecting roadside mailboxes from snow and/or debris thrown by snow plows. A mailbox protector can include a deflection surface which may be adapted to redirect impacting snow and debris away from a mailbox. Such a surface may include a pair of angled sides coming together at a vertex, and/or a curved or arcuate surface. A deflection surface may be installed next to a mailbox using one or more anchor members which may be adapted to fix the position of the mailbox protector relative to a mailbox by mounting it in the ground or in concrete next to the mailbox. Embodiments may be height adjustable and a deflection surface may comprise a plurality of panels assembled edge-to-edge rather a single panel. Embodiments may optionally include a cap which may offer additional protection against thrown snow and debris, and/or may improve the strength of the device.

Figures 1, 2:
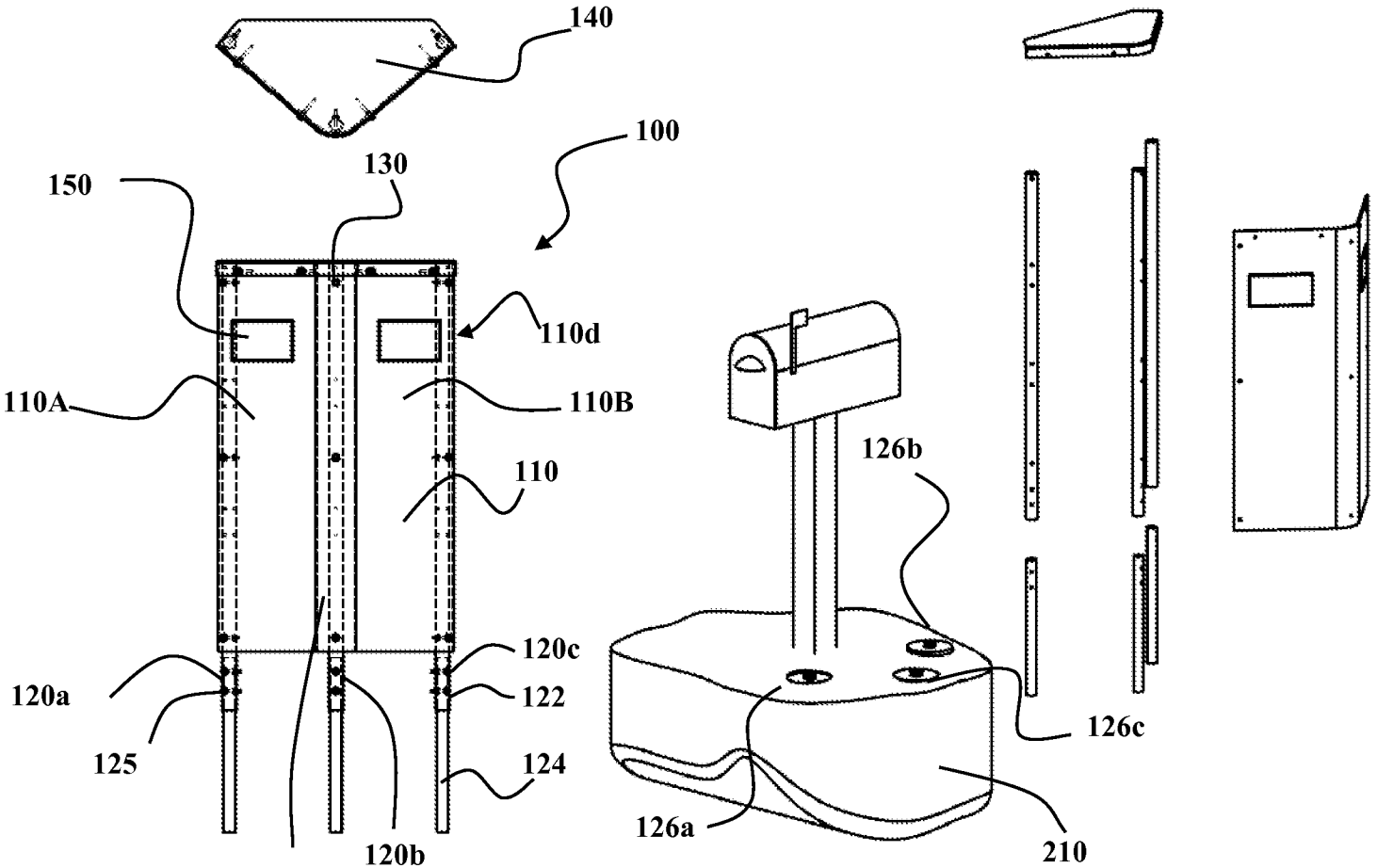
FIG. 1 is a front view of an embodiment.
FIG. 2 is an exploded side view of an embodiment in relation to a mailbox.

Referring now to the drawings wherein the showings are for purposes of illustrating embodiments of the invention only and not for purposes of limiting the same, FIG. 1 is a front view of any embodiment 100 comprising a sheet 110 of organic polymer such as, without limitation, polyolefin. The sheet 110 is angled so as to define a first wall 110A and a second wall 110B which are disposed at an angle relative to each other thereby defining a vertex 110C. The major surface of the sheet 110 which defines an outside angle, i.e. an angle greater than 180 degrees, comprises a front face of the embodiment 100. Conversely, the major surface of the sheet 110 which defines an inside angle, i.e. an angle less than 180 degrees, comprises a rear face of the embodiment 100. The front face of the embodiment 100 may include visual indicia 150 for indicating, for instance, a street address or any other convenient or suitable information. Although, this example shows a single sheet bent at an angle, one skilled in the art would appreciate that a similar structure can be made from two separate sheets which converge to form a vertex, and which may or may not be joined but which nonetheless form a unitary structure. Still further, in some embodiments a shield may include a mailbox as a single unitary structure. For instance, a mailbox and mailbox protector may form a single molded part or an assembly of parts sold as a unit.

According to FIG. 1, an embodiment 100 also includes a set of three length-adjustable male anchors 120*a*, 120*b*, 120*c* which are attached to the sheet 110 with fasteners 130. Each male anchor 120*a*, 120*b*, 120*c* includes a fixed post 122, which is fixed to the sheet member 110 at either an edge 110*d* or a vertex 110*c*. Each fixed post 122 is adapted to receive a smaller diameter sliding post 124 in a slidable, length-adjustable, relation. Furthermore, the length of an assembly of a fixed post 122 and a sliding post 124 can be fixed with means such as, without limitation, a pin passing through co-registered apertures in both posts 122, 124. One skilled in the art will recognize that a wide variety of fixing means may be appropriate and can include, for instance, a spring-loaded registration pin mounted on and extending from the fixed post 122 and adapted to engage an aperture defined by the sliding post 124. In another embodiment, the fixed post 122 and sliding post 124 may engage each other in a threaded relation so that turning the sliding post 124 relative to the fixed post 122 causes the assembly to lengthen or shorten depending on the direction of turn. While the drawings show embodiments with posts that are made separately and then attached to a sheet, one skilled in the art will understand that posts can be made as a continuous part of a sheet. For instance, a sheet may be cut and/or molded so as to define posts as a continuous portion of the sheet, rather than a part which is joined to the sheet.

FIG. 2 illustrates an embodiment where the male anchor members 120*a*, 120*b*, 120*c* correspond to female anchor members 126*a*, 126*b*, 126*c* which are embedded in a substrate 210. Suitable substrates can include, without limitation, the earth around a mailbox, or a poured concrete slab, for instance. According to the embodiment shown in FIG. 2, male components of the anchor members 120*a*, 120*b*, 120*c* can be inserted into corresponding female components 126*a*, 126*b*, 126*c* which may be adapted to retain the male components in a fixed relation. Also shown in both FIG. 1 and FIG. 2 is an optional cap member 140 which is adapted to fixedly engage the sheet 110 at an upper edge, such as in a snap fit or via one or more fasteners.

Figure 3:
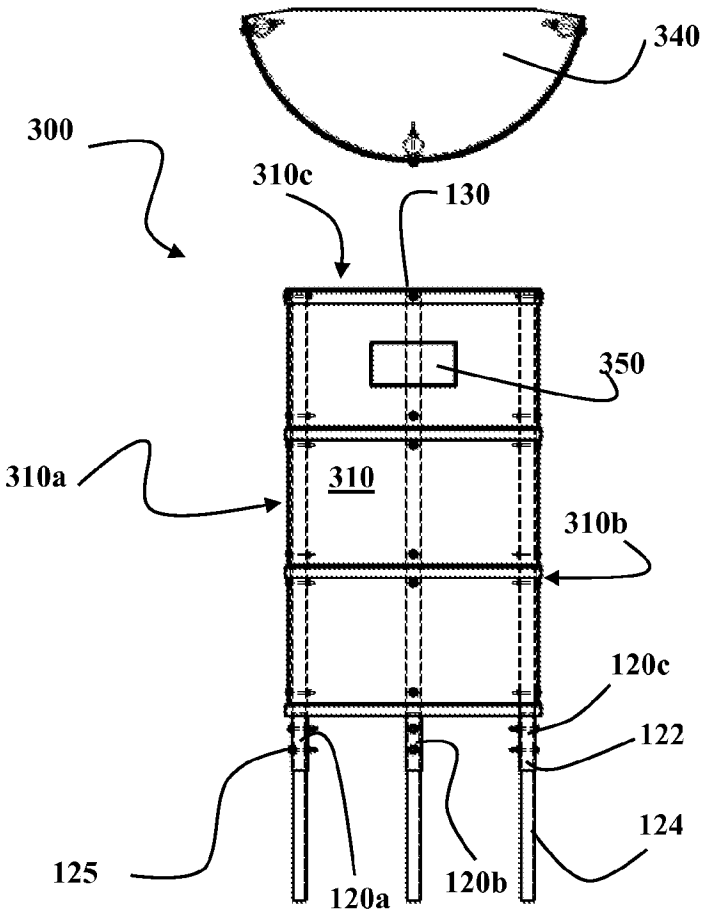
FIG. 3 is a front view of an embodiment having an arcuate deflection surface.

FIG. 3 illustrates an embodiment 300 having a generally arcuate major surface 310 rather than a pair of sides converging to form a vertex as in FIG. 1 and FIG. 2. According to this embodiment 300, a front face is defined by an outside arcuate surface 310 which may include a first edge 310*a* and a second edge 310*b*. Visual indicia 350 may be included on the front face so as to indicate, for instance, a street address or any other appropriate or convenient information. The embodiment 300 may also include an optional cap 340 which may fixedly engage an upward edge 310*c* of the major surface 310, such as in a snap fit or via one or more fasteners.

Figure 4:
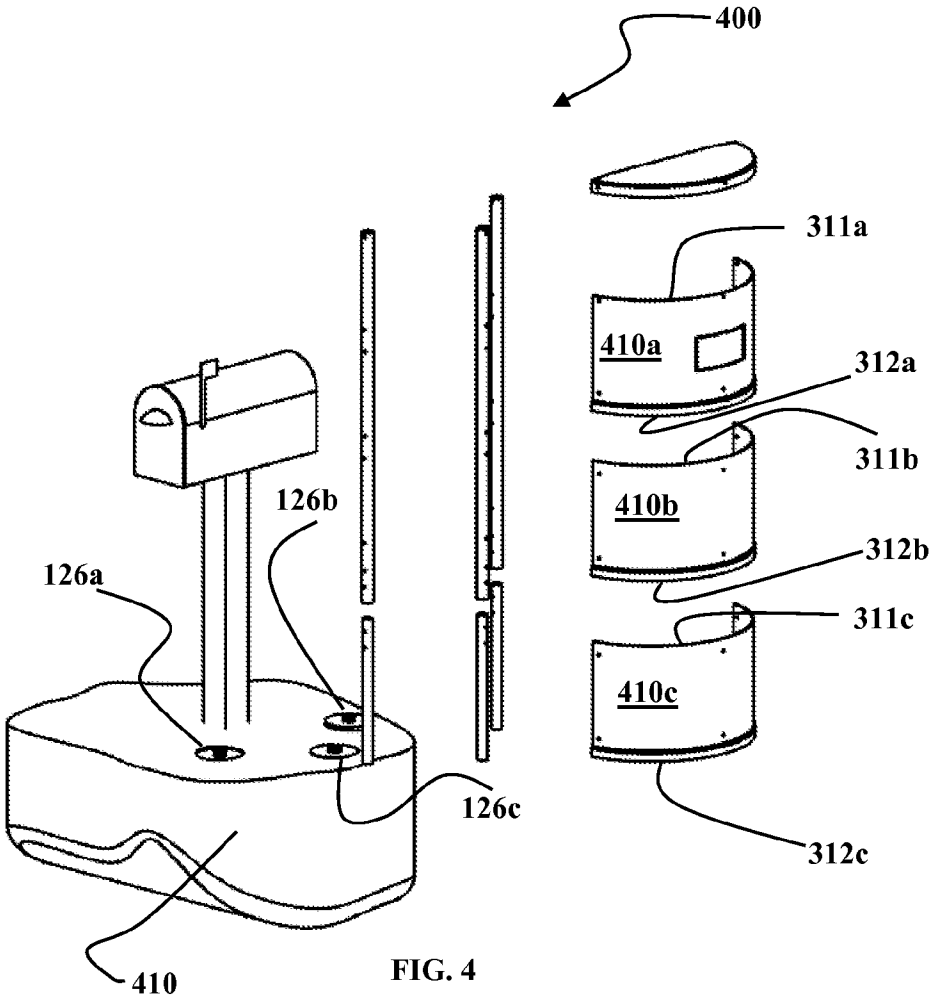
FIG. 4 is a side exploded view of the embodiment of FIG. 3 shown in relation to a mailbox.

As shown in FIG. 4, an embodiment 400 can include a plurality of panels 410*a*, 410*b*, 410*c*. In this embodiment, 400 the panels are serially joined ended to end to form a unitary major surface. As shown, a downward edge 312*a* of a first panel 410*a* may be joined to an upward edge 311*b* of a second panel 410*b*. Similarly, a downward edge 312*b* of the second panel 410*b* may be joined to an upward edge 311*c* of a third panel 410*c*. One skilled in the art will appreciate that any number of panels may be incorporated as needed. Accordingly, embodiments may be height-adjustable. Alternatively, the embodiments 300 or 400 may be height-adjustable by including length-adjustable male anchor members 120*a*, 120*b*, 120*c* and female anchor members 126*a*, 126*b*, 126*c* as previously described in accordance with FIG. 2.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

I claim:

1. A mailbox protector, comprising, a deflection surface adapted to deflect impacting snow and debris thrown by a snow plow;

at least one anchor member in a fixed relation to the deflection surface, wherein the at least one anchor member defines a fixed post which is in a fixed relation to the deflection surface, wherein the at least one anchor member comprises a first anchor member fixedly disposed at a first edge of the deflection surface and mounted thereto, and a second anchor member fixedly disposed at a second edge of the deflection surface and mounted thereto, both the first and second anchor members running substantially the entire length of the respective first and second sides of the deflection surface, wherein the deflection surface comprises one or more of an arcuate major surface, or an angular major surface comprised of two flat sides defining a vertex;

a sliding post adapted to be received within an inner diameter of the fixed post in a slideable relation;

a means for fixing the position of the sliding post in relation to the fixed post; and at least one complementary anchor member adapted to engage the at least one anchor member in a mounting relation, wherein the at least one complementary anchor member is adapted to be fixedly disposed in an arbitrary substrate selected from one or more of concrete, or soil.

2. The mailbox protector of claim 1, wherein the deflection surface comprises a plurality of panels joined edge to edge.

3. The mailbox protector of claim 1, further comprising a cap member adapted to fixedly engage an upper edge of the deflection surface.

4. A mailbox protector, comprising, at least one panel comprising a generally rectangular shape having a first major surface and a second major surface spaced apart from the first major surface in a generally parallel relation and defining a thickness, the major surfaces defining a generally curved shape, and the at least one panel defining an upward edge and a downward edge;

a plurality of panels wherein the plurality of panels is fixedly engaged edge to edge by their respective upward and/or downward edges; and at least one anchor member extending beyond the downward edge of the at least one panel and adapted to engage an arbitrary substrate in a fixed relation, wherein the at least one anchor member includes a female component adapted to be embedded in an arbitrary substrate and engage a male component of the anchor member in a fixed relation.

5. The mailbox protector of claim 4, further comprising a cap member adapted to fixedly engage the upward edge of at least one panel, the cap member comprising a substantially continuous sheet spanning a curved upward edge of the panel.

6. The mailbox protector of claim 4, wherein the at least one anchor member is length-adjustable.

7. A mailbox protector, comprising:

a deflection surface adapted to deflect impacting snow and debris thrown by a snow plow, wherein the deflection surface comprises one or more of an arcuate major surface, or an angular major surface comprised of two flat sides defining a vertex, and wherein the deflection surface comprises a plurality of panels each having an upward edge and a downward edge, the plurality of panels being joined upward edge to downward edge;

a frame comprising a first frame member fixedly disposed at a first side edge of the deflection surface and mounted thereto, and a second frame member fixedly disposed at a second side edge of the deflection surface and mounted thereto, both the first and second frame members running substantially the entire length of the respective first and second side edges of the deflection surface;

at least one anchor member in a fixed relation to the deflection surface, wherein the at least one anchor member comprises a fixed post and a sliding post adapted to be received within an inner diameter of the fixed post in a slideable relation, and the at least one anchor member further comprising a means for fixing the position of the sliding post in relation to the fixed post;

at least one complementary anchor member comprising a female anchor member adapted to engage the at least one anchor member in a mounting relation, wherein the at least one complementary anchor member is adapted to be fixedly disposed in an arbitrary substrate selected from one or more of concrete, or soil; and a cap member adapted to fixedly engage an upper edge of the deflection surface.

8. The mailbox protector of claim 7, comprising three evenly spaced anchor members.

9. The mailbox protector of claim 7, further comprising visual indicia disposed on an outward facing major surface of the deflection surface, wherein the visual indicia comprises one or more of an address number, or a surname.

* * * * *